US008196313B2

(12) United States Patent
Han

(10) Patent No.: US 8,196,313 B2
(45) Date of Patent: Jun. 12, 2012

(54) DRYER AND CONTROL METHOD THEREOF

(75) Inventor: Jong Hye Han, Changwon-si (KR)

(73) Assignee: LG Electronics Inc., Seoul (KR)

( * ) Notice: Subject to any disclaimer, the term of this patent is extended or adjusted under 35 U.S.C. 154(b) by 712 days.

(21) Appl. No.: 12/224,796

(22) PCT Filed: Mar. 14, 2007

(86) PCT No.: PCT/KR2007/001247

§ 371 (c)(1),
(2), (4) Date: Sep. 5, 2008

(87) PCT Pub. No.: WO2007/105908

PCT Pub. Date: Sep. 20, 2007

(65) Prior Publication Data

US 2009/0199427 A1 Aug. 13, 2009

(30) Foreign Application Priority Data

Mar. 14, 2006 (KR) ..... 10-2006-0023667

(51) Int. Cl.
*F26B 3/00* (2006.01)

(52) U.S. Cl. ..... 34/486; 34/484; 34/494

(58) Field of Classification Search ..... 34/486, 34/484, 562, 88, 494
See application file for complete search history.

(56) References Cited

U.S. PATENT DOCUMENTS

| | | | | |
|---|---|---|---|---|
| 4,531,305 | A * | 7/1985 | Nagayasu et al. | 34/445 |
| 4,738,034 | A * | 4/1988 | Muramatsu et al. | 34/524 |
| 5,321,897 | A | 6/1994 | Holst et al. | |
| 5,345,694 | A * | 9/1994 | Hayashi | 34/550 |
| 6,446,357 | B2 * | 9/2002 | Woerdehoff et al. | 34/491 |
| 6,775,923 | B2 * | 8/2004 | Do | 34/527 |
| 6,845,290 | B1 * | 1/2005 | Wunderlin et al. | 700/208 |
| 6,931,759 | B2 * | 8/2005 | Jeong et al. | 34/485 |
| 6,941,674 | B2 * | 9/2005 | Park et al. | 34/88 |
| 2004/0143992 | A1 * | 7/2004 | Do | 34/446 |
| 2005/0278974 | A1 * | 12/2005 | Chung | 34/528 |
| 2009/0090020 | A1 * | 4/2009 | Choi et al. | 34/88 |

FOREIGN PATENT DOCUMENTS

| | | |
|---|---|---|
| CN | 2179399 | 10/1994 |
| CN | 1580379 | 2/2005 |
| DE | 2945696 | 5/1981 |
| DE | 37 03 671 | 8/1988 |
| DE | 4447270 | 7/1996 |
| EP | 1 507 038 | 2/2005 |

OTHER PUBLICATIONS

English translation of Yuan Guanxuan, Oct. 12, 1994, CN2179399(Y). Note: original and abstract provided by Applicant with IDS filed Apr. 6, 2012.*

* cited by examiner

*Primary Examiner* — Kenneth Rinehart
*Assistant Examiner* — Corey J Hall
(74) *Attorney, Agent, or Firm* — McKenna Long & Aldridge LLP

(57) ABSTRACT

A method for controlling a dryer includes the steps of sensing an amount of laundry in the dryer, setting a primary drying time period $T_1$ of the dryer with reference to the amount of laundry sensed thus, setting a secondary drying time period $T_2$ in the middle of drying according to the primary drying time period set thus, and drying the laundry according to the secondary drying time period $T_2$ set thus, whereby permitting setting of a more accurate drying time period because the drying time period of the dryer is set two times.

6 Claims, 6 Drawing Sheets

[Fig. 5]
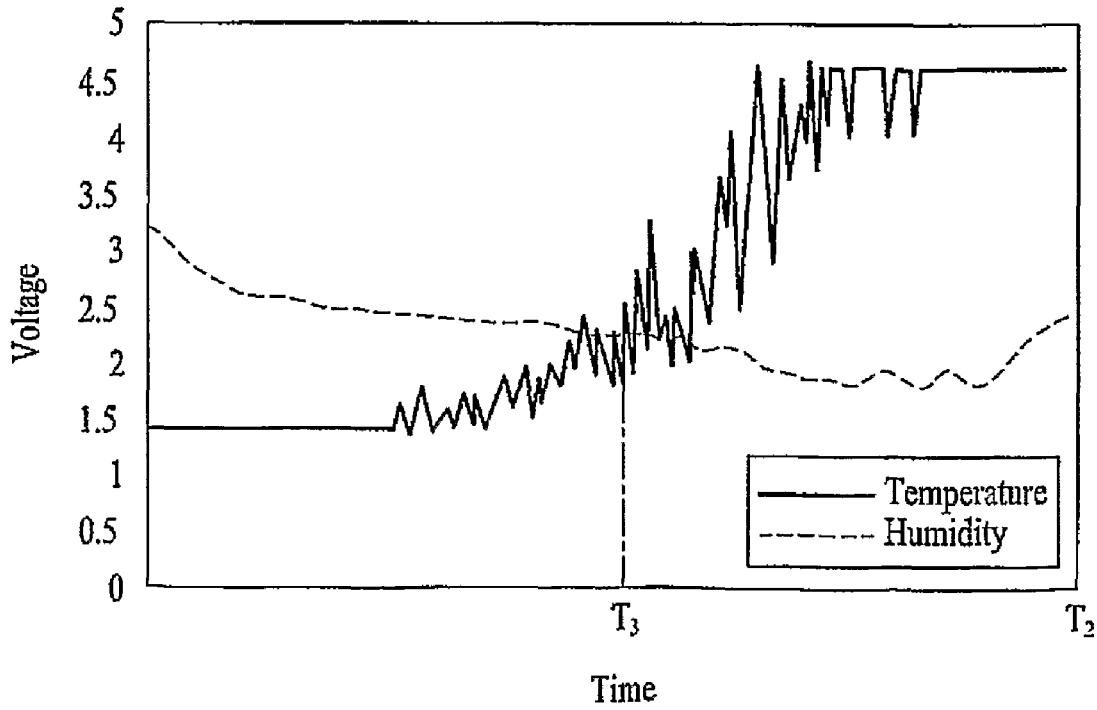

[Fig. 6]
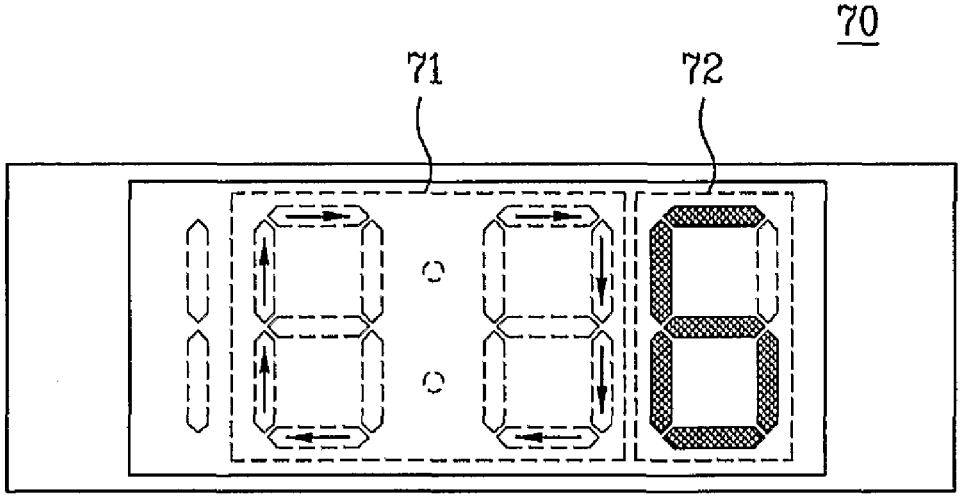
[Fig. 7]
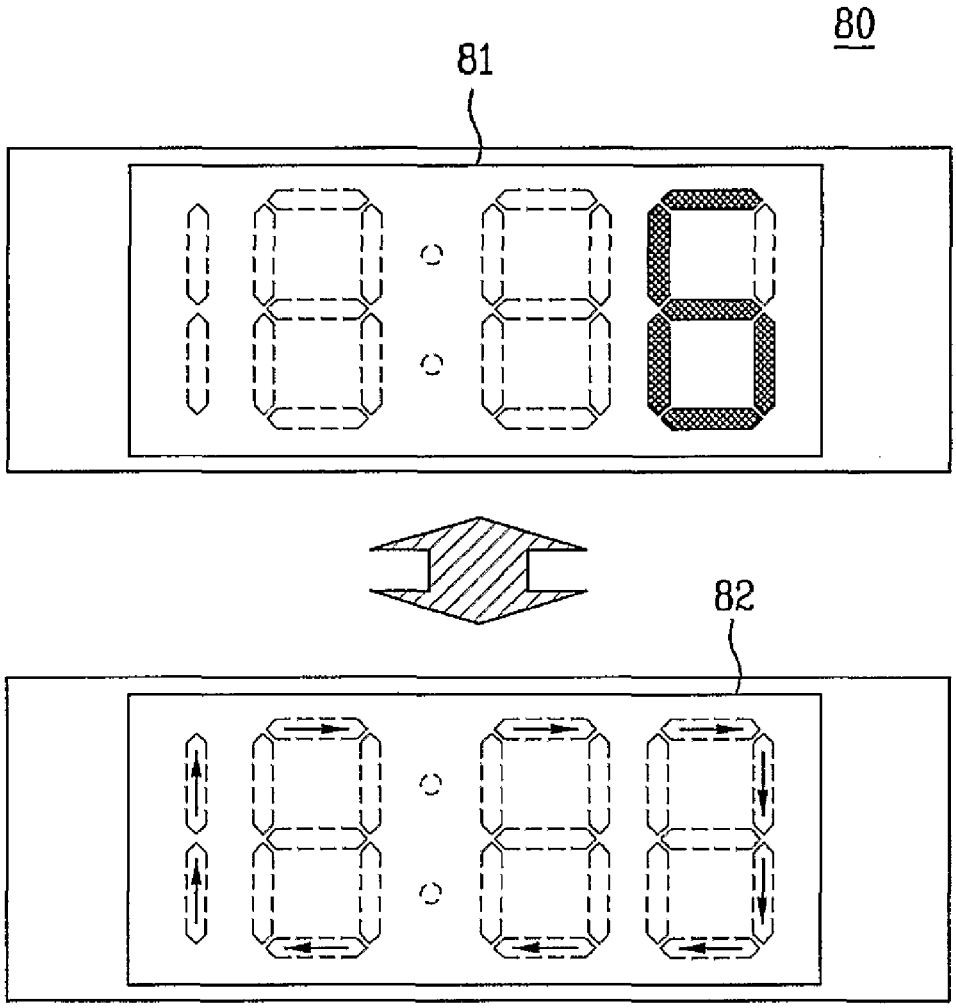

DRYER AND CONTROL METHOD THEREOF

This application claims the benefit of International Application No. PCT/KR2007/001247 filed Mar. 14, 2007 which claims the benefit of Korean Patent Application No. 10-2006-0023667 filed Mar. 14, 2006 are hereby incorporated by reference for all purposes as if fully set forth herein.

TECHNICAL FIELD

The present invention relates to dryers, and more particularly, to a dryer which is convenient to use, and a method for controlling the same.

BACKGROUND ART

In general, for drying a wet washed drying object automatically, a related art dryer has the following system.

FIG. 1 illustrates a longitudinal section of a related art dryer schematically, and FIG. 2 illustrates a section across a line I-I in FIG. 1.

The related art dryer is provided with a body 100 having an introduction opening 101 in a front, a drying drum 30 rotatably mounted in the body 100 having a plurality of agitating pieces 30*a* projected from an inside circumference, a door 105 for selective opening/closing of the introduction opening 101, a motor 50 fixedly secured to the inside of the body 100 for generating rotating force, a belt 60 for transmitting the rotating force from the motor 50 to the drying drum 30, hot air guiding flow passages 10*a*, and 10*b* for guiding an air flow so that external air is introduced into the drying drum 30 and discharged to an outside of the body 100, and an exhaust fan 40 for generating forced air blow force so that the external air is introduced through the hot air guiding flow passage 10*a* and discharging to the outside of the body 100.

The dryer also provided with a microcomputer (not shown) for controlling operation of the dryer, a humidity sensing unit 110 for sensing humidity of an inside of the dryer during progressing drying, and a temperature sensing unit 111 for sensing a temperature of the inside during drying.

The drying operation of the related art dryer will be described with reference to FIG. 3.

FIG. 3 illustrates a flow chart showing the steps of a related art drying method.

Referring to FIG. 3, upon starting drying after introduction of the drying object into the drying drum 30 (S10), a drying time period is set and, then, the heater 20 and the motor 50 are put into operation.

In setting a drying time period in the related art drying method, humidity and so on are measured at regular intervals at the sensing unit, and, if n data are measured only an initially measured data and a finally measured data are compared, to progress the next course.

In the meantime, as the exhaust fan 40 is put into operation, the external air introduced into the body 100 through an inlet side of the hot air guiding flow passage 10*a* is heated to a high temperature to hot air as the external air passes through the heater 20, and forcedly introduced into the drying drum 30 through the hot air guiding flow passage 10*a*. Then, the hot air introduced into the drying drum 30 repeats circulation in which the hot air is discharged to an outside of the body 100 through an outlet side of the hot air guiding flow passage 10*b* while vaporizing moisture from the wet drying object owing to suction force of the exhaust fan 40.

Through above process, the drying drum 30 rotates in regular/reverse directions at regular intervals owing to a driving power transmitted thereto from the motor 50 through the belt 60, to lift and drop the drying object held therein with the agitating pieces 30*a*, during which the drying object is dried (S20).

Finally, if the set time period is passed (S30), operation of the heater 20 and the motor 50 is stopped to finish the drying (S40).

Though not shown, after finishing the drying, cooling is started for dropping an inside temperature of the dryer, and by finishing the cooling after performing the cooling for a preset time period, the door 105 can be opened. In this instance, a cooling time period is fixed in a range of about 5 minutes.

Therefore, if the drying is finished after drying is performed for the preset time period, after performing the cooling for a predetermined time period, the door 105 of the related art dryer can be opened.

However, the related art dryer and the method for controlling a dryer have the following problems.

First, because the next course is progressed with reference to comparison of the initially measured data and the finally measured data only, there is high possibility of wrong progression of the next course due to an error of the data, and an accurate measurement of moisture in a small drying object (approx. below 2 pounds) has been difficult since the moisture contained therein will be small, too.

Second, since the drying is required to be made within an initially set time period, the drying can not be completed if the drying is slow do to a large amount of the drying object, or the drying can be excessive if the drying object is small or the drying is fast.

Third, measurements of the amount of drying object and the water content have been difficult if the amount of the drying object is small.

DISCLOSURE OF INVENTION

Technical Problem

An object of the present invention devised to solve the problem lies on providing a dryer and a method for controlling a dryer which enables an accurate drying time period setting according to an amount of laundry and water content.

Technical Solution

To achieve these objects and other advantages and in accordance with the purpose of the invention, as embodied and broadly described herein, a method for controlling a dryer includes the steps of sensing an amount of laundry in the dryer, setting a primary drying time period $T_1$ of the dryer with reference to the amount of laundry sensed thus, setting a secondary drying time period $T_2$ in the middle of drying according to the primary drying time period set thus, and drying the laundry according to the secondary drying time period $T_2$ set thus.

The step of sensing an amount of laundry in the dryer includes the step of sensing the amount of laundry with a humidity sensor at the dryer, and preferably the amount of the laundry is sensed with reference to frequency of contact of a drying object in the dryer with the humidity sensor.

In the meantime, the step of setting a secondary drying time period $T_2$ includes the step of sensing humidity and temperature of an inside of the dryer for setting the secondary drying time period $T_2$.

The secondary drying time period is set in a case $T_3$ voltage values measured with the humidity sensor and the temperature sensor at the dryer are the same.

The secondary drying time period $T_2$ is set in proportion to a time period $T_3$ in which the voltage values measured with the humidity sensor and the temperature sensor at the dryer are the same, and preferably, the secondary drying time period $T_2$ is calculated with a linear function of the time period $T_3$ in which the voltage values measured with the humidity sensor and the temperature sensor at the dryer are the same.

In the meantime, the method may further include the step of displaying the primary drying time period in succession to the step of setting a primary drying time period $T_1$, and the method may further include the step of changing the primary drying time period to the secondary drying time period and displaying the secondary time period.

Advantageous Effects

Refer to "Industrial Applicability"

BRIEF DESCRIPTION OF THE DRAWINGS

The accompanying drawings, which are included to provide a further understanding of the invention, illustrate embodiments of the invention and together with the description serve to explain the principle of the invention.

In the drawings:

FIG. 5 illustrate a graph showing variations of humidity and temperature of a drying object being dried in a dryer.

FIG. 6 illustrates a front view of a display unit of a dryer showing a display method in accordance with a first preferred embodiment of the present invention.

FIG. 7 illustrates a front view a display unit of a dryer showing a display method of in accordance with a second preferred embodiment of the present invention.

BEST MODE FOR CARRYING OUT THE INVENTION

Reference will now be made in detail to the preferred embodiments of the present invention, examples of which are illustrated in the accompanying drawings. Description of parts identical to the related art will be omitted.

Figure 4:
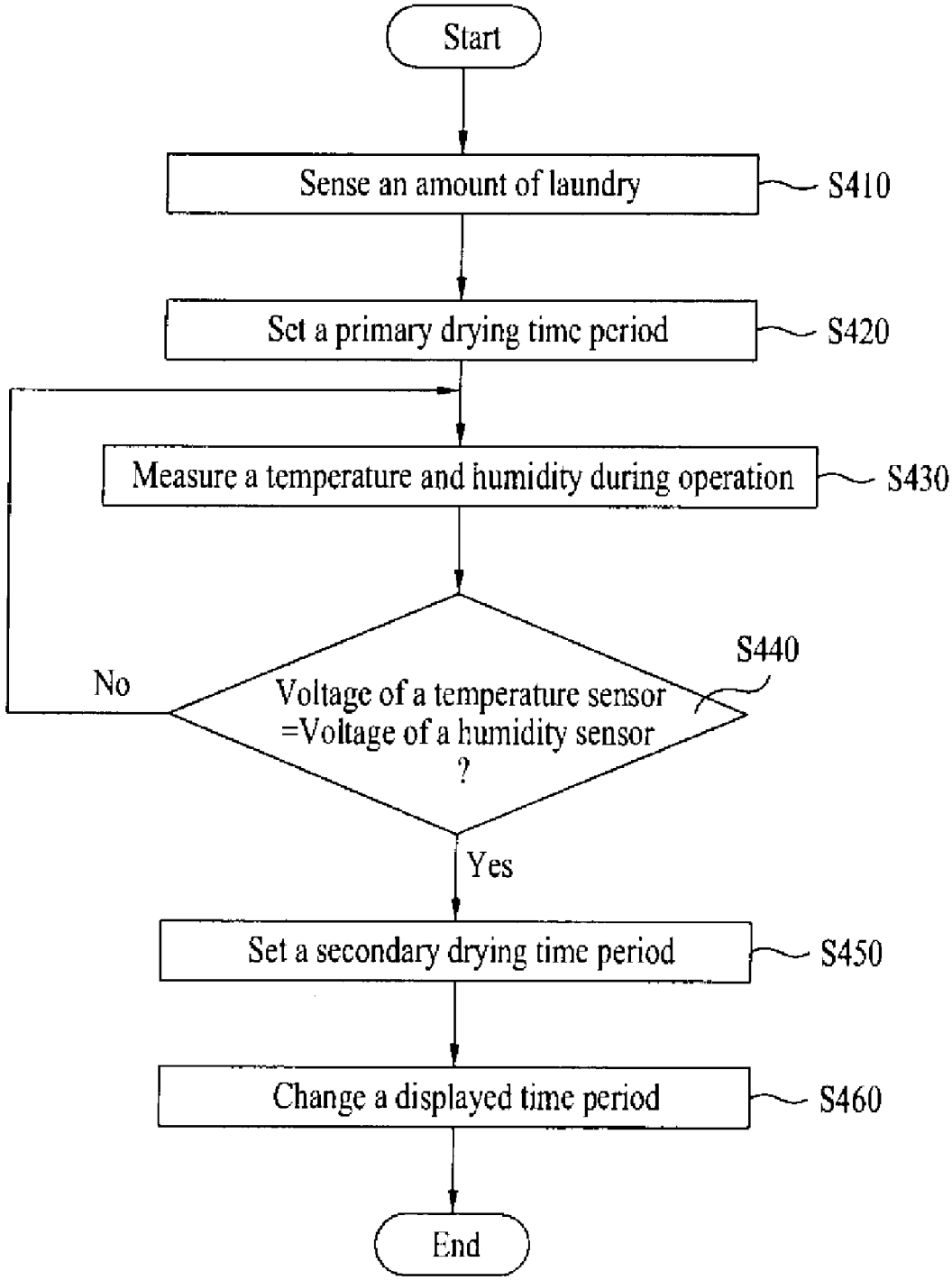
FIG. 4 illustrates a flow chart showing the steps of a method for controlling a dryer in accordance with a preferred embodiment of the present invention.

FIG. 4 illustrates a flow chart showing the steps of a method for controlling a dryer in accordance with a preferred embodiment of the present invention.

A method for controlling a dryer in accordance with a preferred embodiment of the present invention will be described with reference to FIG. 4.

The method for controlling a dryer in accordance with a preferred embodiment of the present invention includes the steps of sensing an amount of laundry in a dryer (S410), setting a primary drying time period $T_1$ according to the amount of laundry sensed thus (S420), and setting a secondary drying time period $T_2$ in the middle of progression of drying according to the primary drying time period (S450). Each of the steps will be described in detail.

Upon putting the dryer of the present invention into operation, an amount of the drying object in the dryer is sensed (S410).

Figure 1:
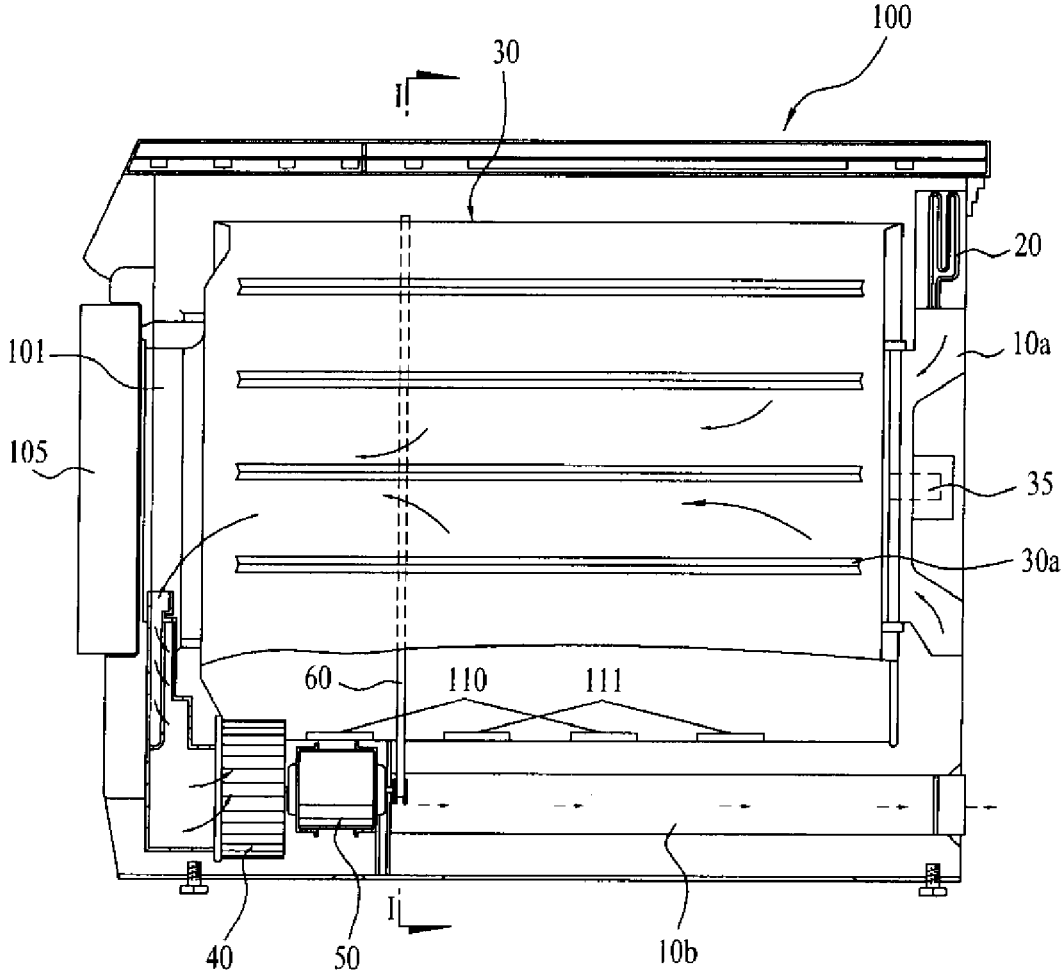
FIG. 1 Prior Art
FIG. 1 illustrates a longitudinal section of a related art dryer schematically.
Figure 2:
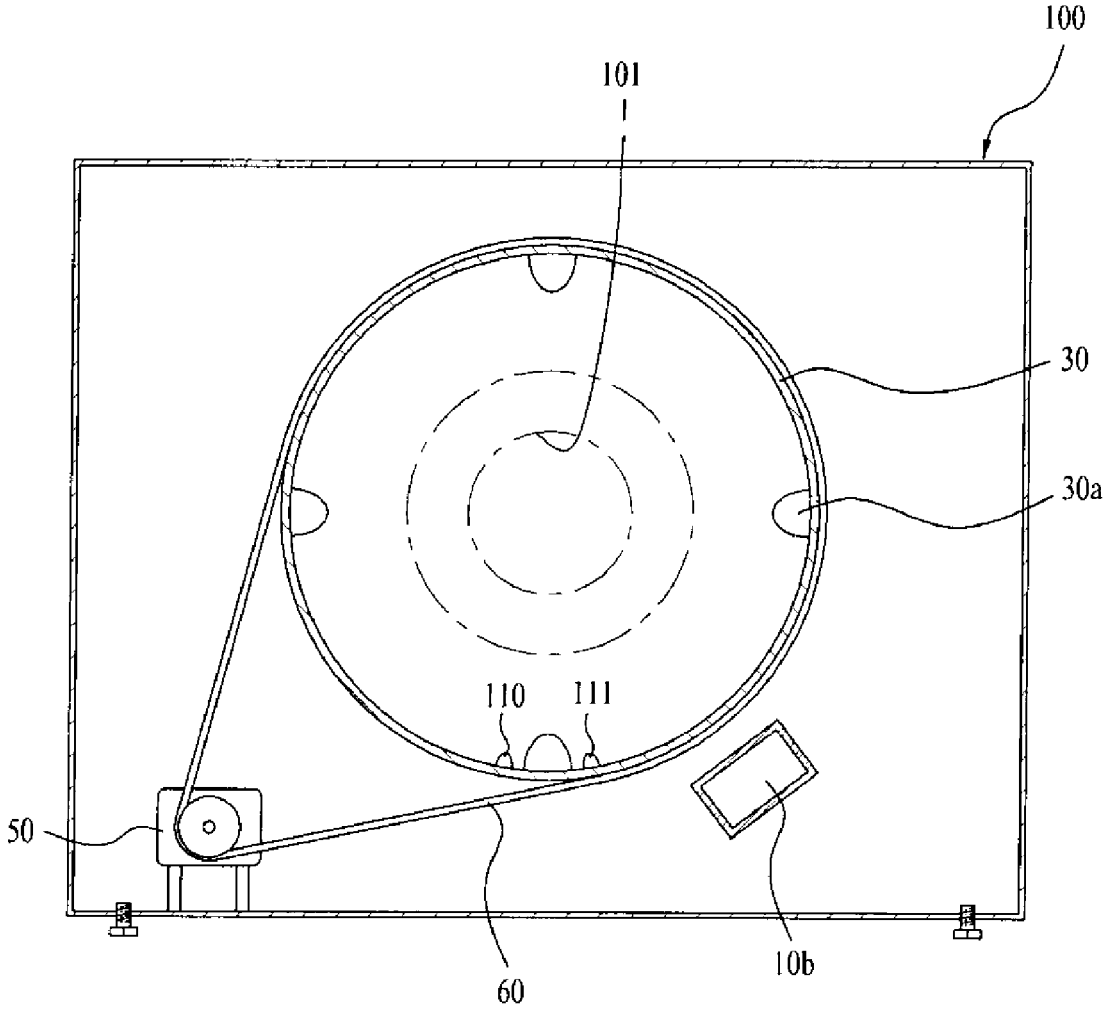
FIG. 2 Prior Art
FIG. 2 illustrates a section across a line I-I in FIG. 1.
Figure 3:
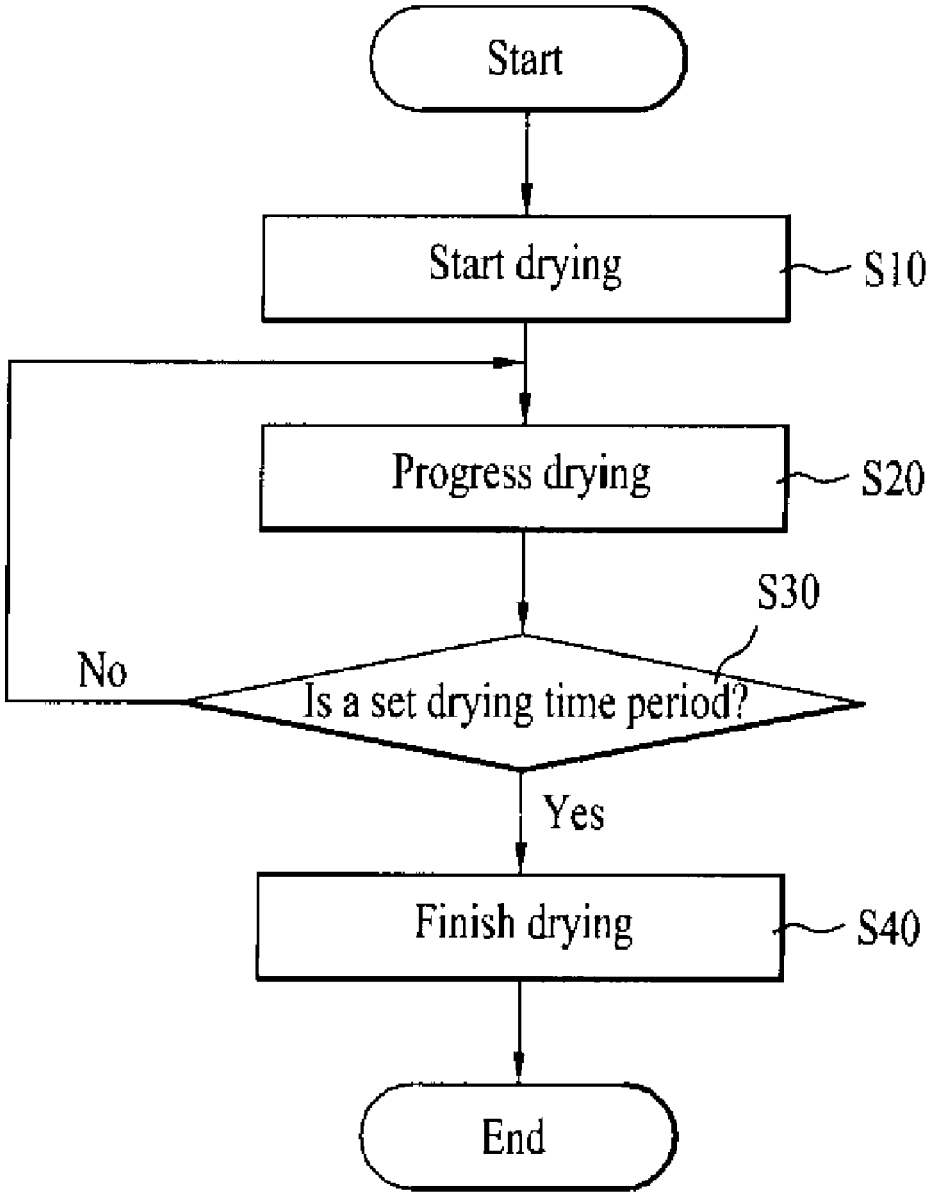
FIG. 3 Prior Art
FIG. 3 illustrates a flow chart showing the steps of a related art control method of a related art dryer.

In detail, the control unit senses the amount in the dryer with the humidity sensor 110 (see FIG. 1). That is, in a case there is a large amount of the drying object in the dryer, the dryer is operated to rotate the drum 30 (see FIG. 1), which leads the drying object to make frequent contact to the humidity sensor 10. Opposite to this, in a case there is a small amount of the drying object in the dryer, even if the dryer is operated to rotate the drum 30, the frequency of the drying object making contact to the humidity sensor 110 is low.

In the meantime, the humidity sensor 110 may be a kind of resistance sensor, for sensing resistance when the resistance sensor is brought into contact with the drying object, converting the resistance into a voltage value, and transmitting the voltage value to the control unit.

Accordingly, the control unit can sense the amount of the drying object by measuring the frequency of the voltage values from the humidity sensor 110. For an example, a data table for calculating the amount according to the frequency of the voltage values transmitted to the control unit is prepared in advance, to calculate the amount according to the data table. In this case, it can be known easily that the greater the frequency of the voltage values, the greater the amount of the drying object, and vice versa.

After sensing the amount of the drying object in the dryer, the control unit sets the primary drying time period $T_1$ according to the amount sensed thus (S420).

After sensing the amount with reference to information from the humidity sensor, the control unit sets the primary drying time period $T_1$ according to the amount sensed thus. The primary drying time period $T_1$ is set properly according to the amount, and the greater the amount, the longer the primary drying time period $T_1$.

In the meantime, though not shown in FIG. 4, after setting the primary drying time period $T_1$, the control unit can display the primary drying time period $T_1$ on the display unit 70 (see FIG. 6). According to this, the user knows a time period required for drying the drying object.

Then, the dryer performs drying according to the primary drying time period $T_1$, and the control unit sets the secondary drying time period $T_2$ in the middle of drying (S450).

This is because there are cases taken place frequently, in which completion of the drying is failed within the primary drying time period due to sensing errors on kinds, and amount of the drying object, and so on, even if the primary drying time period is set by sensing the amount of the drying object. According to this, in a case the drying is not completed within the preset primary drying time period the user determines that the dryer is out of order, and requests service.

Therefore, in the present invention, an accurate drying time period can be calculated by setting the secondary drying time period $T_2$ in the middle of progression of drying according to the primary drying time period.

In the present invention, humidity and temperature are sensed continuously with the humidity sensor 110 and the temperature sensor 111 (see FIG. 1) in the dryer (S430), and the secondary drying time period $T_2$ is set according to the humidity and temperature sensed thus.

FIG. 5 illustrates a graph showing variations of humidity and temperature of a drying object during the dryer is in operation. A method for setting the secondary drying time period will be described in detail with reference to FIG. 5.

As described before, the humility sensor 110 may be a sensor that measures resistance. In a case the drying object is brought into contact with the humidity sensor 110, the higher the humidity of the drying object, the resistance becomes the lower, to drop the resistance of the humidity sensor 110 the lower. In the meantime, the humidity sensor 110 converts the resistance value into a voltage value, and transmits the voltage value to the control unit, wherein the lower the resistance value, the higher the voltage value, and vice versa. Therefore, if the drying object has high moisture content, the voltage value becomes great, and if the drying object has low moisture content, the voltage value becomes small.

Referring to FIG. 5, since the moisture content of the drying object decreases as the drying is progressed in the dryer, the voltage value from the humidity sensor is kept falling.

In the meantime, alike the humidity sensor 110, the temperature sensor 111 may be a kind of resistance sensor. In this case, since the higher the temperature of the drying object, the lower the resistance, the resistance value sensed at the temperature sensor 111 becomes the lower. At the end, in a case the resistance value sensed at the temperature sensor 111 is converted into a voltage value, and the voltage value is transmitted to the control unit, the higher the temperature, the higher the voltage value, and the lower the temperature, the lower the voltage value.

At the end, referring to FIG. 5, when the drying object is dried in the dryer, if a graph is plotted by converting the humidity and the temperature of the drying object into the voltage value, the voltage value that represents the humidity is kept falling, and the voltage value that represents the temperature is kept rising. Therefore, a time point $T_3$ is formed at which the voltage value that represents the humidity and the voltage value that represents the temperature meet if a predetermined time period is passed after the dryer is put into operation, and, therefrom, the humidity is kept falling, and the temperature is kept rising.

In the meantime, the inventor has discovered that the time point $T_3$ at which the voltage value that represents the humidity and the voltage value that represents the temperature meet has a close relation to a total drying time period $T_2$ of the dryer through repetitive experiments. That is, according to the experiments of the inventor, the drying time period $T_2$ of the dryer is proportional to the $T_3$, which can be expressed with an equation 1, below.

$$T_2=AT+B \quad (1)$$

Where, $T_2$ represents a total drying time period of the dryer, that is, in the present invention, the secondary drying time period which is reset in the middle of operation of the dryer, $T_3$ represents a time point when the voltage value that represents the humidity and the voltage value that represents the temperature meet, and A and B are constants.

That is, the inventor has discovered that the total drying time period of the dryer, i.e., the secondary drying time period $T_2$ can be calculated with a linear function of the time point $T_3$ at which the voltage value that represents the humidity and the voltage value that represents the temperature meet through repetitive experiments. The constant A has a value close to unity substantially, and the constant B varies with kinds of the drying object, a capacity of the dryer, an external environment, and so on.

Accordingly, in the control method of the present invention, the humidity and the temperature of the drying object in the dryer are measured continuously with the humidity sensor 110 and the temperature sensor 111 in the middle of operation of the dryer according to the primary drying time period, and the humidity and the temperature are converted into voltage values, and transmitted to the control unit (S430).

The control unit compares the voltage values transmitted thus continuously (S440), and sets the secondary drying time period $T_2$ at the time point $T_3$ when the voltage value that represents the humidity and the voltage value that represents the temperature meet (S450).

In this case, as described before, the control unit sets the secondary drying time period $T_2$ with a linear function of the time point $T_3$ when the voltage value that represents the humidity and the voltage value that represents the temperature meet. Since detailed description of the method for calculating the secondary drying time period is made reference to FIG. 5 already, the description will be omitted.

After setting the secondary drying time period, the control unit displays the secondary drying time period on the display unit 70 (S460).

In this case, the control unit may replace the primary drying time period displayed on the display unit already with the secondary drying time period or the primary drying time period is kept unchanged until a difference of the primary drying time period and the secondary drying time period lapses.

Therefore, since the drying is progressed according to the secondary drying time period, leading an actual drying time period to meet the drying time period displayed on the display unit substantially, the user understands that the dryer is operated, accurately.

In the meantime, FIG. 6 illustrates a front view of a display unit of a dryer showing a display method in accordance with a first preferred embodiment of the present invention, and FIG. 7 illustrates a front view a display unit of a dryer showing a display method of in accordance with a second preferred embodiment of the present invention.

A time display method of a dryer in accordance with a first preferred embodiment of the present invention will be described with reference to FIG. 6.

If the remained drying time period increases compared to the primary drying time period owing to setting of the secondary drying time period, the dryer does not change, but fix, the remained drying time period displayed on the display unit starting from a predetermined time point, and waits to lapse an added time period.

However, if the fixing of time is to be continuous for more than a predetermined time period, for an example, 30 seconds, a unique symbol 71 is displayed in a state the time displayed on the display unit 70 is fixed, so that the user knows that the drying course is being delayed.

It is preferable that the symbol 71 is displayed on a left side or right side of a time display region 72 of the display unit 70 adjacent thereto. Because, if the symbol is at a place where the user pays attention for determining the remained drying time period, the symbol 71 can be found, easily.

Even though it is preferable that the symbol 71 is a mark in a shape in FIG. 6 which indicates that the dryer is in operation, a character may be used. The symbol 71 may be flashing entirely, or flashing in a direction in succession, or fixed.

If the time period added to the initially set drying time period is passed fully, the symbol 71 is erased, and only the time is displayed as displayed, originally.

A time display method of a dryer in accordance with a second preferred embodiment of the present invention will be described with reference to FIG. 7.

Referring to FIG. 7, if it is required that the display unit 80 is fixed for more than the predetermined time period, the control unit outputs a remained time period output frame 81 and a specific symbol output frame 82 which represents the dryer is in operation, alternately.

It is preferable that a time period of the frame alteration is within two seconds which is a time period the users can sense the alternation of the frame. However, if frequent alteration of the frame causes an excessive power consumption, the period of the frame alternation may be determined, taking the excessive power consumption into account. Alike the first embodiment, the specific symbol output frame 82 may be flashed, or fixed.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The dryer and the method of controlling a dryer of the present invention have the following advantages.

First, the peak to peak type measurement of the moisture content in the drying object permits an accurate determination of the drying time period.

Second, even if the amount of the drying object is small, the amount can be sensed accurately, to permit an effective operation of the dryer.

Third, by means of the re-setting step, the drying time period can be set more accurately.

The invention claimed is:

1. A method for controlling a dryer comprising the steps of:

sensing an amount of laundry in the dryer;

setting a primary drying time period $T_1$ of the dryer with reference to the amount of laundry sensed thus;

setting a secondary drying time period $T_2$ during drying according to the primary drying time period $T_1$ set thus;

drying the laundry according to the secondary drying time period $T_2$ set thus; and wherein the step of setting a secondary drying time period $T_2$ includes the step of sensing humidity and temperature of an inside of the dryer for setting the secondary drying time period $T_2$ wherein the secondary drying time period $T_2$ is set in proportion to a time point $T_3$ and the time point $T_3$ is formed at which the voltage values measured with the humidity sensor and the temperature sensor at the dryer are the same.

2. The method as claimed in claim 1, wherein the step of sensing an amount of laundry in the dryer includes the step of sensing the amount of laundry with a humidity sensor at the dryer.

3. The method as claimed in claim 2, wherein the amount of the laundry is sensed with reference to frequency of contact of a drying object in the dryer with the humidity sensor.

4. The method as claimed in claim 1, wherein the secondary drying time period $T_2$ is calculated with a linear function of the time period $T_3$ in which the voltage values measured with the humidity sensor and the temperature sensor at the dryer are the same.

5. The method as claimed in claim 1, further comprising the step of displaying the primary drying time period in succession to the step of setting a primary drying time period $T_1$.

6. The method as claimed in claim 5, further comprising the step of changing the primary drying time period to the secondary drying time period and displaying the secondary time period.

* * * * *